US012414635B1

(12) United States Patent
Cao

(10) Patent No.: US 12,414,635 B1
(45) Date of Patent: Sep. 16, 2025

(54) HIGH-ELASTIC ANTI-DEFORMATION MATTRESS

(71) Applicant: Chunguo Pan, Yunnan (CN)

(72) Inventor: Aiyun Cao, Shangrao (CN)

(73) Assignee: Chunguo Pan, Yuxi (CN)

( * ) Notice: Subject to any disclaimer, the term of this patent is extended or adjusted under 35 U.S.C. 154(b) by 0 days.

(21) Appl. No.: 19/094,829

(22) Filed: Mar. 29, 2025

(51) Int. Cl.

| | |
|---|---|
| ***A47C 27/045*** | (2006.01) |
| ***A47C 27/05*** | (2006.01) |
| ***A47C 27/06*** | (2006.01) |
| ***A47C 27/12*** | (2006.01) |
| ***A47C 27/15*** | (2006.01) |
| ***A47C 27/20*** | (2006.01) |
| ***A47C 27/22*** | (2006.01) |

(52) U.S. Cl.
CPC ..... *A47C 27/0456* (2013.01); *A47C 27/056* (2013.01); *A47C 27/064* (2013.01); *A47C 27/122* (2013.01); *A47C 27/15* (2013.01); *A47C 27/20* (2013.01); *A47C 27/22* (2013.01)

(58) Field of Classification Search
CPC ... A47C 27/0456; A47C 27/20; A47C 27/056; A47C 27/064; A47C 27/144; A47C 27/142; A47C 27/22; A47C 17/14; A47C 13/005
See application file for complete search history.

(56) References Cited

U.S. PATENT DOCUMENTS

| | | | | |
|---|---|---|---|---|
| 2,194,569 A * | 3/1940 | Rumpf | A47C 27/20 5/717 |
| 3,099,021 A * | 7/1963 | Wetzler | A47C 27/20 264/46.7 |
| 3,401,411 A * | 9/1968 | Morrison | A47C 7/18 5/655.8 |
| 3,623,171 A * | 11/1971 | Arkin | A47C 27/20 267/143 |
| 3,833,952 A * | 9/1974 | Rosenberg | A47C 7/34 244/122 A |
| 4,429,427 A * | 2/1984 | Sklar | A47C 27/20 5/655.9 |
| 4,862,540 A * | 9/1989 | Savenije | A47C 27/148 5/655.9 |
| 6,948,205 B2 * | 9/2005 | Van Der Wurf | A47C 27/20 5/718 |
| 9,339,117 B1 | 5/2016 | Limer et al. | |

(Continued)

*Primary Examiner* — Matthew Troutman
*Assistant Examiner* — Alison N Labarge
(74) *Attorney, Agent, or Firm* — Ricky Lam

(57) ABSTRACT

The present invention relates to the technical field of mattresses, and particularly provides a high-elastic anti-deformation mattress. The high-elastic anti-deformation mattress includes a mattress assembly which includes a first layer, a second layer and a third layer from top to bottom in a sequence; a plurality of assembling chambers are formed in the second layer, and each assembling chamber is filled with a vertically upward spring; a large-diameter end of each spring is upwards close to a top portion of the corresponding assembling chamber, and a small-diameter end of each spring is downwards connected to a top surface of the third layer; a connecting base is inserted into a large end of a top portion of each spring; reinforcing nets are mounted among all the connecting bases, and the peripheries of the reinforcing nets are close to the peripheries of the first layer and the second layer.

8 Claims, 2 Drawing Sheets

(56) References Cited

U.S. PATENT DOCUMENTS

| | | | | |
|---|---|---|---|---|
| 11,819,135 | B2 | 11/2023 | Kardeh et al. | |
| 11,839,308 | B2 | 12/2023 | Ribicic | |
| 12,232,627 | B2 | 2/2025 | Teller | |
| 2013/0239323 | A1* | 9/2013 | Schulz, Jr. | A47C 23/02 5/247 |
| 2015/0226278 | A1* | 8/2015 | Voros | A47C 27/064 144/380 |

* cited by examiner

HIGH-ELASTIC ANTI-DEFORMATION MATTRESS

FIELD OF THE INVENTION

The present invention relates to the technical field of mattresses, and particularly relates to a high-elastic anti-deformation mattress.

BACKGROUND OF THE INVENTION

Mattresses are designed to provide people with a comfortable sleeping environment. With the development of society and the continuous improvement of human requirements, existing mattresses are made of multi-layer composite cushions in combination with different materials, such as latex layer, and a memory foam layer, and in order to improve the comfort, each layer has a plurality of layers of units stacked.

Due to the number of layers, the anti-deformation ability of the existing mattresses are improved, in which spring filling is a common measure, that is, a large number of springs are filled in the mattresses as support. In general, the spring in this way lacks a firm structure in a radial direction, and it will bend sideways when bearing the load of a human body, which will cause the mattresses to collapse prematurely over time, affecting the service life.

SUMMARY OF THE INVENTION

In order to solve the above problems, the present invention provides a high-elastic anti-deformation mattress. The high-elastic anti-deformation mattress includes a mattress assembly which includes a first layer, a second layer and a third layer from top to bottom in a sequence; a plurality of assembling chambers are formed in the second layer, and each assembling chamber is filled with a spring; a top end of each spring is upwards close to a top portion of the corresponding assembling chamber, and a bottom end of each spring is downwards connected to a top surface of the third layer; a connecting base is inserted into each of the top end and the bottom end of each spring; reinforcing nets are connected among all the connecting bases on the top portion, and reinforcing nets are also connected among all the connecting bases at the bottom portion; the peripheries of the reinforcing nets on the top portion are close to the periphery of the first layer, and the peripheries of the reinforcing nets at the bottom portion are close to the periphery of the second layer; an elastic insertion rod is connected between each upper connecting base and the corresponding lower connecting base; the elastic insertion rods downwards wrap the springs from the top ends to the bottom ends; each assembling chamber is filled with a tubular independent packaging cushion; the springs wrapped with the elastic insertion rods are jointly embedded into the independent packaging cushions; outer circular surfaces of the independent packaging cushions are tightly attached to the chamber surfaces of the assembling chambers; and the springs and the outer circular surfaces of the independent packaging cushions are tightly attached to the chamber surfaces of the independent packaging cushions.

As a further preference, the first layer, the second layer and the third layer are all filled with a mixture of slow-rebounded memory foam, sponge and latex as flexible fillers; the first layer, the second layer and the third layer are connected in a sewing mode; the independent packaging cushions and the elastic insertion rods are made of high-density latex; and the elastic insertion rods are filled with the springs, and outer walls of the springs are close to outer walls of the elastic insertion rods.

As a further preference, the bottom ends of the independent packaging cushions reach a top surface of the third layer, and the top ends of the independent packaging cushions reach a top surface of the second layer.

As a further preference, the springs are made of high-quality alloy steel, and the surfaces of the springs are electroplated.

As a further preference, the second layer is of a multi-layer structure formed by overlapping a plurality of first unit layers and a plurality of second unit layers; the first unit layers are filled with a mixture of latex and sponge, the second unit layers are filled with high-density coconut fibers, and the second unit layers are located on the bottom layer of the first unit layers; the top ends of the plurality of assembling chambers downwards penetrate through top portions of the first unit layers, and the bottom ends of the assembling chambers downwards penetrate through bottom portions of the second unit layers; and the plurality of assembling chambers are formed in the first unit layers and the plurality of second unit layers in a matrix mode.

As a further preference, the third layer is filled with hard fibers.

As a further preference, wavy spring wires are arranged on four edges of the mattress assembly, high points of the wavy shape are connected to the bottom surface of the first layer, and bottom points of the wavy shape are connected to the third layer.

As a further preference, the first layer, the second layer and the third layer are jointly sleeved with anti-skid and wear-resistant backing fabric, the backing fabric is a mite-proof fabric, and air holes are formed in the backing fabric.

Compared with the related technology, the high-elasticity deformation-resistant mattress according to the present invention has the beneficial effects that:

a set of reinforcing nets is arranged on each of the upper surface and the lower surface of the second layer of the mattress; the large number of assembling chambers are formed in the mattress; the plurality of elastic insertion rods are uniformly arranged on the two sets of reinforcing nets, and each insertion rod is inserted into the corresponding assembling chamber, so that the two sets of reinforcing nets and the mattress can be fixed in a large area; during use, the load can be transmitted to the elastic insertion rods and the mattress by means of the reinforcing nets, the elastic insertion rods use the springs filled inside for amplifying the buffering effect, and the independent packaging cushions are forcibly thickened in the radial direction; the radial force generated by thickening of the independent packaging cushions in the radial direction acts on the chamber walls of the assembling chambers, and then acts on the mattress through the chamber walls of the assembling chambers; the assembling chambers are also formed in the second layer and the third layer, so the second layer and the third layer also have elasticity in the radial direction, that is, the radial force is released towards the peripheral directions of the second layer and the third layer, particularly, the assembling chambers near the periphery, meanwhile, part of axial force can be released in the radial direction after the load is axially borne by the springs, and the axial force is further transmitted to the periphery of the mattress through the peripheries of the reinforcing nets; and when the mattress bears the load, the load is totally concentrated to the middle area of the mattress, and can also be transmitted to the peripheral area of the mattress, so that the mattress is uniformly stressed; during lowering buffering, the deformation can be prevented, the mattress is kept horizontal state, and thus the service life of the mattress is prolonged.

Figure 1:
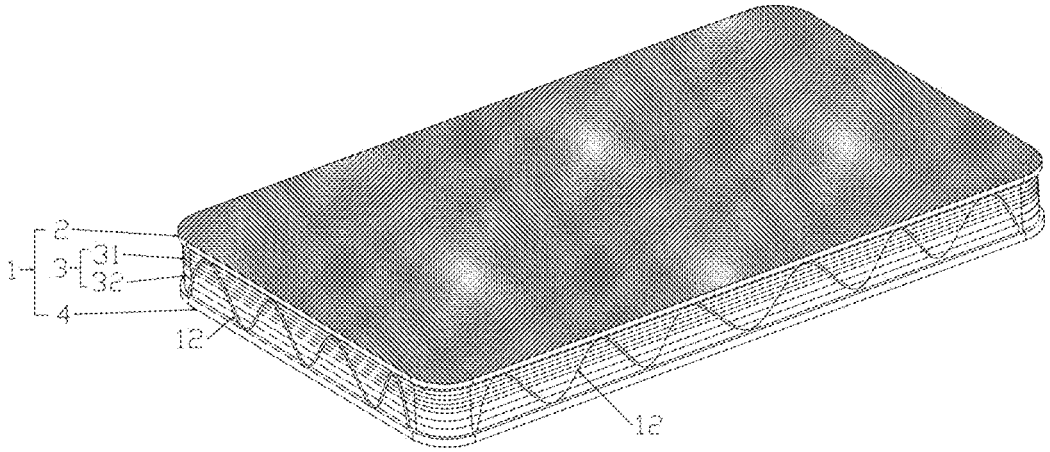
FIG. 1 is an external schematic diagram of a high-elastic anti-deformation mattress provided by an embodiment of the present invention (backing fabric removed)

In figures: 1, mattress assembly; 2, first layer; 3, second layer; 31, first unit layer; 32, second unit layer; 4, third layer; 5, spring; 6, connecting base; 7, reinforcing nets; 8, assembling chamber; 10, elastic insertion rod; 11, independent packaging chamber; 12, spring wire.

DETAILED DESCRIPTION OF SOME EMBODIMENTS

The following embodiments and advantages of the present invention are clearly and completely described in conjunction with the accompanying drawings. Obviously, the described embodiments are only partial embodiments of the present invention, not all embodiments.

In an embodiment, as shown in FIG. 1 to FIG. 4:

this embodiment provides a high-elastic anti-deformation mattress. The high-elastic anti-deformation mattress includes a mattress assembly 1 which includes a first layer 2, a second layer 3 and a third layer 4 from top to bottom in a sequence; a plurality of assembling chambers 8 are formed in the second layer 3, and each assembling chamber 8 is filled with a spring 5; a top end of each spring 5 is upwards close to a top portion of the corresponding assembling chamber 8, and a bottom end of each spring 5 is downwards connected to a top surface of the third layer 4; a connecting base 6 is inserted into each of the top end and the bottom end of each spring 5; reinforcing nets 7 are connected between all the connecting bases 6 on the top portion, and reinforcing nets 7 are also connected between all the connecting bases 6 at the bottom portion; the peripheries of the reinforcing nets 7 on the top portion are close to the periphery of the first layer 2, and the peripheries of the reinforcing nets 7 at the bottom portion are close to the periphery of the second layer 3; an elastic insertion rod 10 is connected between each upper connecting base and the corresponding lower connecting base 6; the elastic insertion rods 10 downwards wrap the springs 5 from the top ends to the bottom ends; each assembling chamber 8 is filled with a tubular independent packaging cushion 11; the springs 5 wrapped with the elastic insertion rods 10 are jointly embedded into the independent packaging cushions 11; outer circular surfaces of the independent packaging cushions 11 are tightly attached to the chamber surfaces of the assembling chambers 8; the springs 5 and the outer circular surfaces of the independent packaging cushions 11 are tightly attached to the chamber surfaces of the independent packaging cushions 11; and the reinforcing nets 7 are of a grid structure formed by fine steel bars and are sequentially connected to each connecting base 6 in a grid form, so that a plurality of connecting points are formed between the mattress and the reinforcing nets 7, and a layer of reinforcing structure is formed on each of the top surface and the bottom surface of the second layer 3. The first layer 2 and the second layer 3 are filled by high-density and slow-rebound memory foam or latex as the flexible fillers, so good pressure resistance and comfort are realized.

Working principle and effect: when people lies on the first layer 2, the resulted load is transmitted to the second layer 3 from the first layer 2, then transmitted to the third layer 4 through the second layer 3, and simultaneously transmitted to the reinforcing nets 7 through the first layer 2; the reinforcing nets 7 transmit the load downwards to the second layer 3, and then the load is transmitted to the third layer 4 through the second layer 3; the reinforcing nets 7 have the characteristic of hardness of fine steel bars and the structural characteristic of grid shape, so the top surface of the second layer 3 can bear the load in a large area, that is, the second layer 3 can uniformly release the load according to the length and width directions of the mattress; in addition, the reinforcing nets 7 are also filled between the bottom portion of the second layer 3 and the third layer 4 in the same way, upper and lower areas of the mattress can be uniformly stressed during bearing the load, and thus the mattress can be prevented from collapsing towards the local middle area; moreover, the upper and lower areas of the mattress are uniformly stressed to achieve a firm effect, and further, the mattress is prevented from collapsing towards the local middle area; the resulted load is transmitted to the connecting bases 6 through the reinforcing nets 7, then transmitted to the elastic insertion rods 10 through the upper and lower connecting bases 6, and the elastic effect of the elastic insertion rods 10 is utilized to further improve the comfort level; moreover, the upper and lower ends of the elastic insertion rods 10 are utilized to form elastic support for the upper and lower reinforcing nets 7, which assists the upper and lower reinforcing nets 7 in bearing gravity, and the gravity is decomposed into each assembling chamber 8, so that the deformation resistance of the mattress is improved; the elastic insertion rods 10 are not simply inserted into the assembling chambers 8, but the independent packaging cushion 11 is arranged in each assembling chamber 8; the elastic insertion rods 10 are filled with the springs 5, and when the elastic insertion rods 10 are compressed, radial thickening will be inevitably caused, and the radial force caused by radial thickening acts on the springs 5, and is enhanced with the assistance of the springs 5, thereby preventing excessive deformation; at the same moment, the springs 5 play a reinforcing effect on the elastic insertion rods 10; when the elastic insertion rods 10 are compressed, the springs 5 assist the elastic insertion rods 10 in amplifying the elasticity, thereby further improving the comfort level; the radial force generated by the elastic insertion rods 10 due to compression is subjected to radial buffering protection by the independent packaging cushions 11, then is transmitted to the chamber walls of the assembling chambers 8 and acts on the second layer 3 and the third layer 4 through the chamber walls of the assembling chambers 8; the assembling chambers 8 are originally formed in the second layer 3 and the third layer 4, and the second layer 3 and the third layer 4 are elastic in the radial direction, that is, the radial force is released towards the peripheral directions of the second layer 3 and the third layer 4, particularly the assembling chambers 8 close to the periphery; at the moment, after load force is axially borne by the springs 5, part of the axial force will be released towards the radial direction, and transmitted to the periphery of the mattress through the peripheries of the reinforcing nets 7; and therefore, when the mattress bears the load, the load is completely concentrated on the middle area of the mattress and can be transmitted to the peripheral area of the mattress, the mattress will be uniformly stressed, the service life of the mattress is prolonged, and the surface of the mattress is kept horizontal.

It is to be further noted that the first layer 2 and the second layer 3 are filled with the mixture of slow-rebounded memory foam, sponge and latex as the flexible fillers, and the comfort level of a human body is improved when the people lies down; and moreover, the fillers interact, so the mattress has good pressure resistance, and is prevented from deformation, and the service life of the mattress is prolonged. The first layer 2, the second layer 3 and the third layer 4 are connected in a sewing and bonding way and are wrapped with independent backing fabrics, and the backing fabrics are connected together in a sewing or bonding mode and then are combined through a layer of backing fabric from the outer surfaces; and under the limiting effect of the backing fabrics on the four edges, mutual displacement of all layers of cushions can be prevented during being stressed. The backing fabrics are anti-mite fabrics, air holes are formed in the backing fabrics for ventilating and avoiding moisture, and the anti-mite fabrics are more environmentally friendly.

Figure 3:
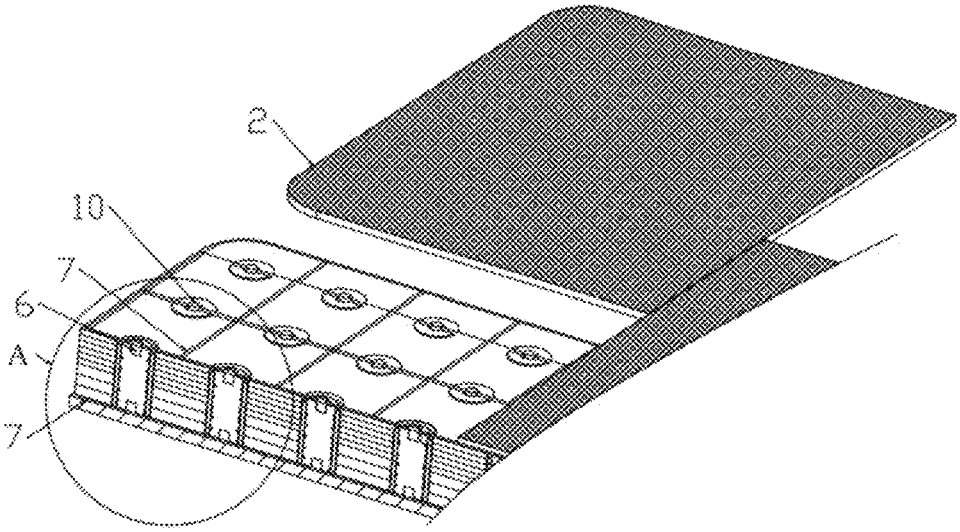
FIG. 3 is a schematic diagram of a high-elastic anti-deformation mattress in FIG. 2 provided by an embodiment of the present invention at another visual angle after splitting.
Figure 4:
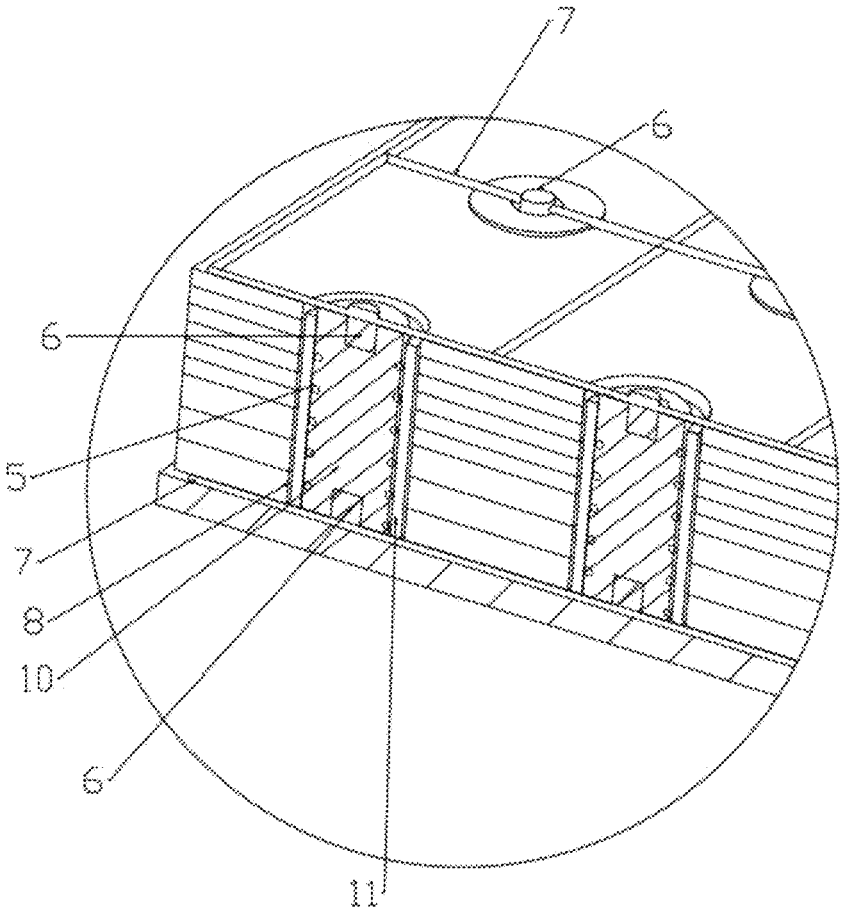
FIG. 4 is an enlarged schematic diagram of a part A in FIG. 3 of a high-elastic anti-deformation mattress provided by an embodiment of the present invention.

As shown in FIG. 3 and FIG. 4, the bottom ends of the independent packaging cushions 11 reach the top surface of the third layer 4, the top ends of the independent packaging cushions 11 reach the top surface of the second layer 3, the independent packaging cushions 11 are radially located in the assembling chambers 8 by the aid of an attaching relationship between the outer wall and the chamber walls of the assembling chamber 8, and are axially located in the assembling chambers 8 by the aid of the attaching relationship between the bottom surface of the first layer 2 and the top surface of the third layer 4; the springs 5 are embedded into the independent packaging cushions 11, so that the springs 5 cannot bend and deform when bearing pressure caused by loading human body; and the independent packaging cushions 11 are equivalent to a layer of flexible substances filled between the springs 5 and the assembling chambers 8, namely, the contact area and the friction force between the springs 5 and the mattress are increased, and thus overall stability is improved. Under the orientation of the independent packaging cushions 11, the bearing capacity and the elastic recovery capacity of the springs 5 are improved.

It is to be further noted that the springs 5 are made of high-quality alloy steel and have high strength and toughness, and the surfaces of the springs 5 are electroplated, so that rusting and corrosion are prevented.

It is to be further noted that as shown in FIG. 1, the second layer 3 is of a multi-layer structure formed by overlapping a plurality of first unit layers 31 and a plurality of second unit layers 32, the first unit layers 31 are filled with a mixture of latex and sponge, the second unit layers 32 are filled with high-density coconut fibers, and the second unit layers 32 are located at the bottom layer of the first unit layers 31; the bottom layer is close to the bed bottom and is more easily affected with damp, the second unit layers 32 are filled with high-density coconut fibers, the coconut fibers are a natural material and have environmental friendliness, and moreover, the coconut fibers are also conductive to ventilation and dryness of the second unit layers 32, thus blocking the bottom from being affected with damp. The first unit layers 31 on the second unit layers 32 are closer to the human body and still have better comfort due to that the first unit layers 31 are filled with the mixture of latex and sponge.

It is to be further noted that as shown in FIG. 3 and FIG. 4, the top ends of the plurality of assembling chambers 8 downwards penetrate through top portions of the first unit layers 31, and the bottom ends of the assembling chambers 8 downwards penetrate through bottom portions of the second unit layers 32; the plurality of assembling chambers 8 are formed in the first unit layers 31 and the plurality of second unit layers 32 in a matrix mode; the spring 5 is arranged in each assembling chamber 8, and a stress body consisting of the connecting base 6 and the grids (each grid unit of the reinforcing nets 7) is arranged in the upper end of each spring 5, so that the surface of the mattress is uniformly stressed, the mattress is prevented from deforming during bearing the load, and the service life is prolonged.

It is to be further noted that the third layer 4 is filled with hard fibers, so the strength of the third layer 4 is improved; when in use, the bottom surface of the third layer 4 falls on a bed body to bear the gravity of the whole mattress, thus a supporting effect is implemented for the bottoms of the springs 5, and meanwhile, the third layer 4 is prevented from being crushed by the springs 5, and the strength is improved.

Figure 2:
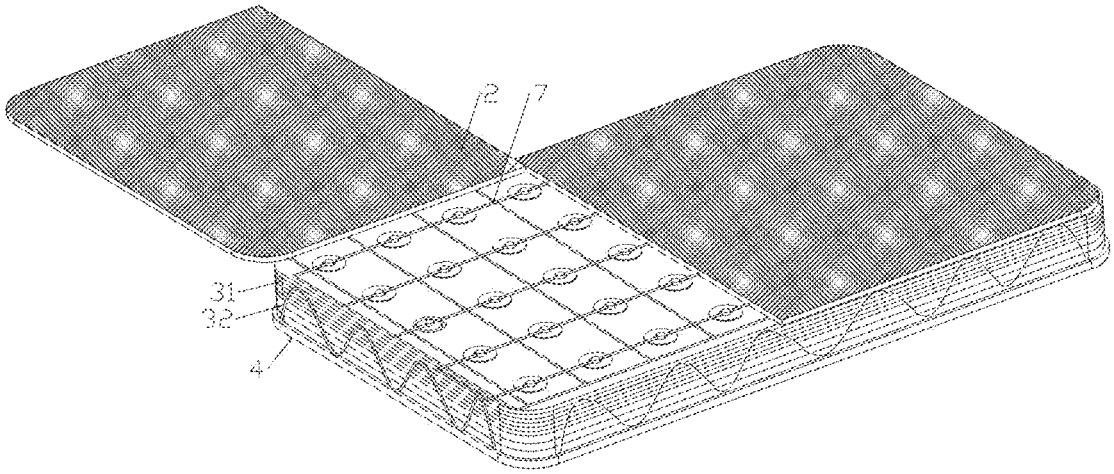
FIG. 2 is a schematic diagram of a high-elastic anti-deformation mattress provided by an embodiment of the present invention after a first layer is broken, which facilitates observation to a structure of a reinforcing net and a connection relationship between the reinforcing net and a connecting base.

It is to be further noted that as shown in FIG. 1 and FIG. 2, wavy spring wires 12 are arranged on four edges of the mattress assembly 1, high points of the wavy shape are connected to the bottom surface of the first layer 2, and bottom points of the wavy shape are connected to the third layer 4; top portions of the spring wires 12 are connected to the reinforcing nets 7, and bottom portions of the spring wires 12 are connected to the third layer 4, so that four sides of the periphery of the mattress are elastically supported; the gravity of the human body on the first layer 2 is counteracted towards the periphery by the reinforcing nets 7 and absorbed by each layer of cushion below; besides being counteracted due to the supporting of the large number of springs 5, the gravity transmitted to the periphery can also be neutralized due to the supporting of the spring wires 12, thus further preventing the periphery of the mattress from collapsing.

The above orientation does not represent the specific orientation of each component in the embodiment, and the embodiment is only for the convenience of the description of the solution, and with reference to the orientation in the diagram for relative description setting, the essence is that the specific orientation of each component is described according to its actual installation and actual use and the habitual orientation description of those skilled in the art.

The specific embodiment described above is further described in detail the present invention purpose, technical scheme, and beneficial effect of the present invention. It should be understood that the above is only a specific embodiment of the present invention and is not used to limit the scope of protection of the present invention. In particular, it is pointed out that for those skilled in the art, any modification, equivalent replacement, improvement, etc., made within the spirit and principles of the present invention shall be included in the scope of protection of the present invention.

What is claimed is:

1. A high-elastic anti-deformation mattress, comprising a mattress assembly (1) which includes a first layer (2), a second layer (3) and a third layer (4) from top to bottom in a sequence, wherein a plurality of assembling chambers (8) are formed in the second layer (3), and each assembling chamber (8) is filled with a spring (5); a top end of each spring (5) is upward towards a top portion of the corresponding assembling chamber (8), and a bottom end of each spring (5) is downwards connected to a top surface of the third layer (4); a connecting base (6) is inserted into each of the top end and the bottom end of each spring (5); reinforcing nets (7) are connected between all the connecting bases (6) on the top portion, and reinforcing nets (7) are also connected between all the connecting bases (6) at the bottom portion; an elastic insertion rod (10) is connected between each upper connecting base and the corresponding lower connecting base (6); the elastic insertion rods (10) downwards wrap the springs (5) from the top ends to the bottom ends; each assembling chamber (8) is filled with a tubular independent packaging cushion (11); the springs (5) wrapped with the elastic insertion rods (10) are jointly embedded into the independent packaging cushions (11); outer circular surfaces of the independent packaging cushions (11) are tightly attached to chamber surfaces of the plurality of assembling chambers (8); and the springs (5) and the outer circular surfaces of the independent packaging cushions (11) are tightly attached to the chamber surfaces of the independent packaging cushions (11).

2. The high-elastic anti-deformation mattress according to claim 1, wherein the first layer (2), the second layer (3) and the third layer (4) are all filled with a mixture of rebound memory foam, sponge and latex as flexible fillers; the first layer (2), the second layer (3) and the third layer (4) are connected in a sewing mode; the independent packaging cushions (11) and the elastic insertion rods (10) are made of high-density latex; and the elastic insertion rods (10) are filled with the springs (5).

3. The high-elastic anti-deformation mattress according to claim 2, wherein bottom ends of the independent packaging cushions (11) reach the top surface of the third layer (4), and top ends of the independent packaging cushions (11) reach a top surface of the second layer (3).

4. The high-elastic anti-deformation mattress according to claim 3, wherein the springs (5) are made of alloy steel, and surfaces of the springs (5) are electroplated.

5. The high-elastic anti-deformation mattress according to claim 4, wherein the second layer (3) is of a multi-layer structure formed by overlapping a plurality of first unit layers (31) and a plurality of second unit layers (32); the first unit layers (31) are filled with a mixture of latex and sponge, the second unit layers (32) are filled with high-density coconut fibers, and the second unit layers (32) are located on bottom layers of the first unit layers (31); top ends of the plurality of assembling chambers (8) downwards penetrate through top portions of the first unit layers (31), and bottom ends of the plurality of assembling chambers (8) downwards penetrate through bottom portions of the second unit layers (32); and the plurality of assembling chambers (8) are formed in the first unit layers (31) and the plurality of second unit layers (32) in a matrix mode.

6. The high-elastic anti-deformation mattress according to claim 5, wherein the third layer (4) is filled with fibers.

7. The high-elastic anti-deformation mattress according to claim 6, wherein wavy spring wires (12) are arranged on four edges of the mattress assembly (1), high points of wavy shape of the wavy spring wires (12) are connected to a bottom surface of the first layer (2), and bottom points of the wavy shape of the wavy spring wires (12) are connected to the third layer (4).

8. The high-elastic anti-deformation mattress according to claim 6, wherein the first layer (2), the second layer (3) and the third layer (4) are jointly sleeved with anti-skid and wear-resistant backing fabric, the backing fabric is a mite-proof fabric, and air holes are formed in the backing fabric.

* * * * *